US011338258B2

(12) United States Patent
Smotritskiy et al.

(10) Patent No.: US 11,338,258 B2
(45) Date of Patent: May 24, 2022

(54) ROTARY-PULSATION DEVICE

(71) Applicant: LIMITED LIABILITY COMPANY "BIOENERGY", Ekaterinburg (RU)

(72) Inventors: Aleksandr Andreevich Smotritskiy, Ekaterinburg (RU); Andrey Vladimirovich Smotritskiy, Ekaterinburg (RU)

(73) Assignee: LIMITED LIABILITY COMPANY "BIOENERGY", Ekaterinburg (RU)

( * ) Notice: Subject to any disclaimer, the term of this patent is extended or adjusted under 35 U.S.C. 154(b) by 188 days.

(21) Appl. No.: 16/575,400

(22) Filed: Sep. 19, 2019

(65) Prior Publication Data

US 2021/0086147 A1 Mar. 25, 2021

(51) Int. Cl.

| | |
|---|---|
| ***B22C 5/00*** | (2006.01) |
| ***B01F 27/271*** | (2022.01) |
| ***F04D 23/00*** | (2006.01) |
| ***F04D 7/04*** | (2006.01) |
| ***B01F 27/60*** | (2022.01) |

(52) U.S. Cl.

CPC ..... *B01F 27/2711* (2022.01); *B01F 27/60* (2022.01); *F04D 7/045* (2013.01); *F04D 23/006* (2013.01)

(58) Field of Classification Search

CPC combination set(s) only.
See application file for complete search history.

(56) References Cited

U.S. PATENT DOCUMENTS 3,995,838 A * 12/1976 Zucker ..... B01F 3/1221 366/160.2
4,136,971 A 1/1979 Varlamov

FOREIGN PATENT DOCUMENTS

| | | | | |
|---|---|---|---|---|
| EP | 0086460 A1 * | 8/1983 | ..... | F04D 29/059 |
| EP | 2092975 A2 * | 8/2009 | ..... | B01F 7/00816 |
| RU | 2152819 C1 * | 7/2000 | | |
| RU | 2152819 C1 | 7/2000 | | |

(Continued)

OTHER PUBLICATIONS

Machine Translation of Description of EP0086460 A1, Aug. 1983 (Year: 1983).*

(Continued)

*Primary Examiner* — Anshu Bhatia
*Assistant Examiner* — Gregory Y Huan
(74) *Attorney, Agent, or Firm* — Nixon & Vanderhye PC

(57) ABSTRACT

Devices for treating aqueous pulps of organic materials usable in the food industry, perfumes, in the production of technical and food alcohol, in the processing of organic waste, etc., are provided. A rotary-pulsation device contains a drive, a stator, and a rotor installed in a housing. A vibration sensor is installed on an outer side of the stator to diagnose conditions of the working bodies and for continuous correction the shaft rotation speed. Reliability of the rotary-pulsation device and processing efficiency are increased by reducing manual cleaning related stops and breakage-related failures. The scope of usage is expanded because automatic processing of water pulps containing large-sized and extended fragments becomes possible; the treated pulp is saturated with small gas bubbles; and automation capabilities may be expanded when integrating the device into substrate processing systems.

7 Claims, 5 Drawing Sheets

(56) References Cited

FOREIGN PATENT DOCUMENTS

| | | | | |
|---|---|---|---|---|
| RU | 2516559 | C2 * | 5/2014 | |
| RU | 2516559 | C2 | 5/2014 | |
| RU | 2667451 | C1 | 7/2017 | |
| WO | 9816304 | A1 | 4/1998 | |
| WO | WO-2016156320 | A1 * | 10/2016 | ..... C09K 8/588 |

OTHER PUBLICATIONS

Machine Translation of Description of EP2092975 A2, Aug. 2009 (Year: 2009).*
Machine Translation of Description of RU2152819 C1, Jul. 2000 (Year: 2000).*
Machine Translation of Description of RU2516559 C2, May 2014 (Year: 2014).*
Machine Translation of Description of WO2016156320 A1, Oct. 2016 (Year: 2016).*

* cited by examiner

ROTARY-PULSATION DEVICE

FIELD OF TECHNOLOGY TO WHICH THE INVENTION RELATES

The invention belongs to the devices for the treatment of water pulps of organic materials, and can be used in the food industry, perfumery, in the production of industrial and edible alcohol, in the processing of organic waste, in food production, in the pharmaceutical industry, for the production of fuel mixtures, paints, lubricants, livestock feed, etc.

BACKGROUND

The closest analogue that may be taken as a prototype is a rotary pulsation apparatus (Patent RU 2516559, Oct. 2, 2014), containing the drive, the body with inlet and outlet nozzles and the rotor and stator installed in the body, on the working surfaces of which there are concentric rows of studs arranged around the circumference, the input blades rigidly attached to the working surface of the rotor, and the output blades that are the protrusions of the last row of spikes and grooves, and the device is equipped with additional input blades, The device is equipped with additional inlet blades installed between the inlet blades on the rotor, which is installed with a possibility of reverse rotation, while the length of the additional inlet blades is less than the length of the pump inlet blades, the axis of symmetry of the additional inlet blades, inlet blades and output blades are located radially and the longitudinal axis of the discharge nozzle and the central axes of the rotor and stator are in a straight line.

The disadvantages of the analogue are:

- There is no possibility to get information about the device status, which increases the probability of device failure and makes it more complicated to design intelligent control systems for this device;
- Insufficient degree of processing due to non-optimal geometry of the working bodies (rotor and stator);
- When processing fibrous and coarse lump materials, the device may become clogged. No self-cleaning of the device is available. A high probability of clogging limits the application area of the device. It is difficult to identify a clogging situation in automatic mode, the clogging can only be eliminated by manual cleaning, which requires disassembly of the device;
- The mechanical face seal used in the device often fails due to the presence of abrasive particles in the raw materials;
- Insufficient pressure characteristics of the device increases its probability of clogging and, in some cases, makes it necessary to install additional pumps at the device outlet.

SUMMARY OF THE INVENTION

The objective of the claimed invention is to improve operational properties (such as reliability and efficiency of the substrate processing, as well as resistance to clogging, breaks in the substrate supply and gas injection) of a rotary-pulsation device that performs hydraulic shock impact on a substrate, to increase the impact on the substrate particles, to enable substrate saturation with microbubbles, homogenization of water slurries and grinding of organic inclusions, as well as hydraulic shock impact on organic inclusions used in the food and pharmaceutical industries, as well as in the disposal of organic waste.

The technical results that may be achieved by the invention are:

- increased reliability of the device achieved by reduction of the number/duration of the device stops for manual cleaning and reducing the number of failures due to breakdowns of the working bodies, increasing the service life of the mechanical seals;
- increased processing efficiency;
- reduction in the specific energy consumption for the processing of substrates with an unstable composition due to the optimization of the processing regime for each portion of substrates;
- the scope expansion due to the ability to automatically process aqueous substrates containing large-sized particles and extended fragments, providing the possibility of saturation of the processed substrate with small gas bubbles;
- expansion of automation possibilities during integration of the device into processing systems.

The problem is solved, and the technical result is achieved due to a rotary-pulsation device, comprising a drive, a stator and a rotor installed in a housing, wherein working surfaces of the stator and rotor contain at least three rows of teeth, each row forms a circle, all rows are concentrically arranged around a rotation axis, grooves are formed between adjacent rows of teeth, the teeth of adjacent rows are offset relative to each other, and wherein: (a) inner impeller blades are formed on the working surface of the rotor between the rotation axis and said three rows of teeth; (b) the working surface of the rotor contains outer impeller blades formed on the outer side of the rotor and protruding beyond the outer diameter of the rotor; (c) the stator has a fluid inlet fitting, equipped with a valve, said fitting is configured for elimination of a substrate clogging; (d) a gas supply fitting is installed in the housing, connected by gas supply channels with gas flow distribution elements clamped by a sealing cover; (e) a vibration sensor is installed on the outer side of the stator and configured to perform diagnostics of working conditions of the device, adjustments of rotation speed of the rotor, and adjustments of the substrate supply to the device.

In some embodiments of the invention, the device is characterized by the fact that inlet of the device is set in the stator, and an outlet of the device is set in the housing; an outer wall of the housing is made in the form of a cone, and a radius of the cone is increasing towards the outlet of the device. In some embodiments of the invention, the device is characterized by the fact that a corrugation in the form of knurling is made on each of the gas flow distribution elements and on the sealing cover. In some embodiments of the invention, the device is characterized by the fact that the front edge of the teeth is made at an acute angle, in the range of 70-85 degrees, relative to a edge velocity vector.

The technical result is also achieved due to the fact that each element of the gas flow distribution and the sealing cover is corrugated in the form of knurling. The technical result is also achieved due to the fact that the front edge of the rotor and stator teeth is made at a sharp angle (angle $\alpha$ at the FIG. 4), in the range of 70-85 degrees, relative to the vector of the edge velocity.

DETAILED DESCRIPTION OF THE INVENTION

Figure 1:
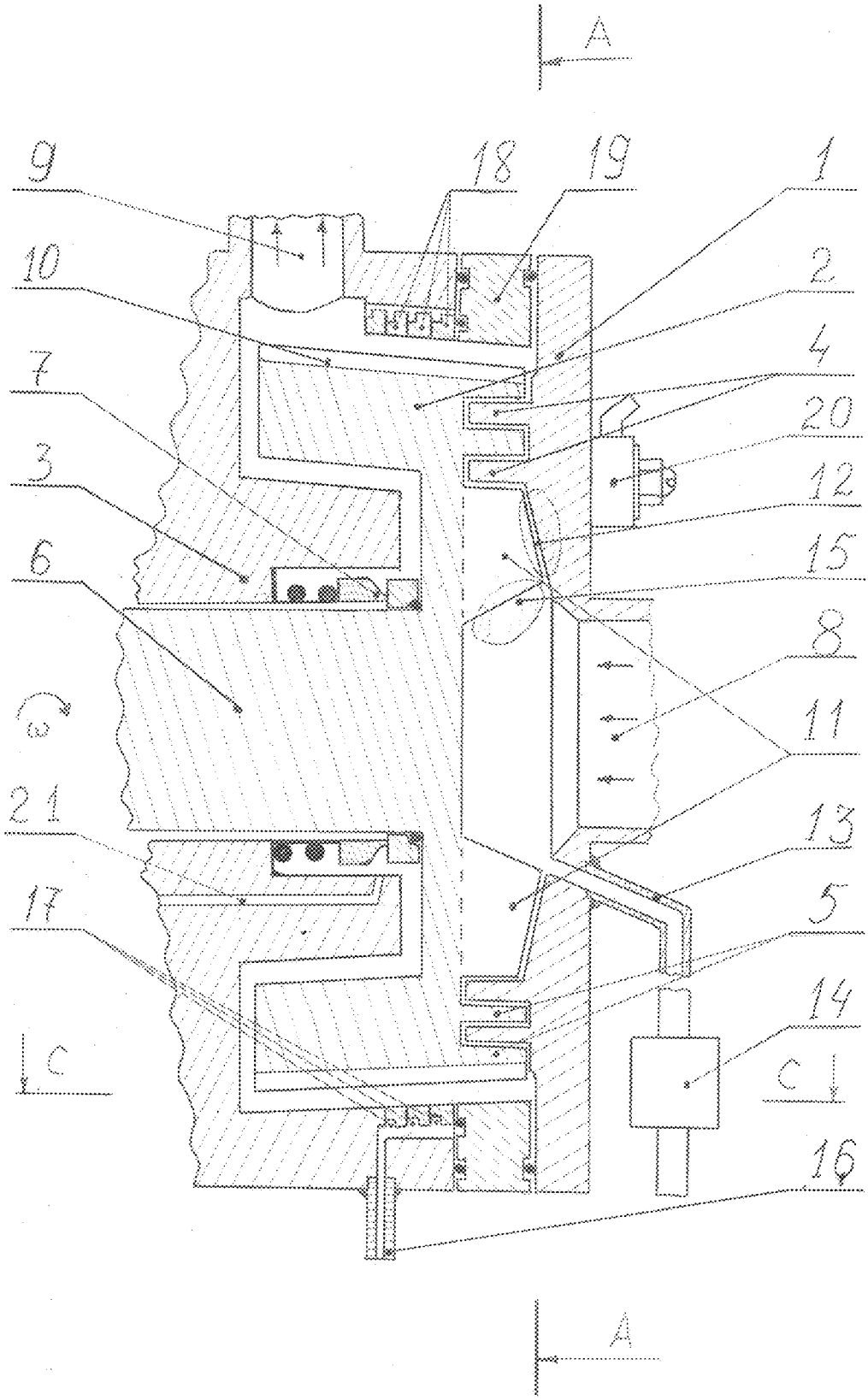
FIG. 1 shows an embodiment of an organic substrate processing device according to the present invention, the general view (section). The following positions are indicated on the FIG.: 1—stator (with rack wheel); 2—rotor (impeller); 3—housing; 4—stator teeth (serrated elements); 5—rotor teeth (serrated elements); 6—drive shaft; 7—shaft seal; 8—inlet; 9—outlet; 10—outer impeller blades; 11—inner impeller blades; 12—abrasion zone for substrate particles; 13—fluid inlet fitting; 14—valve; 15—sticking zone for substrate particles; 16—gas supply fitting; 17—gas supply channels; 18—gas flow distribution elements; 19—sealing cover; 20—vibration sensor (sound receiver); 21—fluid supply channel to the seal zone, A-A—cross section plane cut; C-C—longitudinal section plane cut.

Terms and Definitions.

Aqueous slurry (pulp) of organic materials, or substrate—suspension of organic particles of different shapes and sizes in water. Water may contain inorganic components such as dissolved salts. Organic particles usually contain inorganic particles such as sand, stones, metal and glass particles;

Rotor (impeller)—a rotating part directly interacting with the pulp (or substrate) processed;

Stator (with rack wheel) stationary part directly interacting with the pulp (or substrate) processed;

Working bodies—a pair of rotor and stator parts, the interaction of which leads to the substrate processing;

Impeller—the central part of the rotor (impeller), on which the inner blades are located. Blades accelerate the incoming substrate flow for the interaction with the first row of stator teeth;

Feed fitting—a part that provides connection of the pipeline with water or gas to the device for water slurry treatment, if necessary, equipped with a valve;

Vibration sensor—primary transducer of elastic vibrations of the device housing cover, resulting from the interaction of pulp with the working bodies, into the electrical signal supplied to the specialized spectrum analyzer, based on the microprocessor.

Unless otherwise specified, the technical and scientific terms in this application have standard meanings, generally accepted in the scientific and technical literature.

There are several reasons why similar rotary-pulsation devices known in the art may start malfunctioning or stop working:

(1) Abrasive Wear of Working Bodies (Rotor and Stator)

In course of operation of a device, a gradual change in the size of some areas of working bodies takes place, as well as some areas of the body due to erosion by abrasive particles. The wear and tear of the working bodies leads to a gradual deterioration in the quality of the raw materials processing; and at the same time, the spectrum of vibrations, accompanying the processing, is changing.

Typically, a deterioration in the quality of substrate processing in production is detected with a significant time delay usually as a result of an analysis of the reasons for decrease in the quality of processing. Working bodies replacement is usually carried out after identifying the need for replacement during pre-scheduled technological breaks. As a result, the equipment may not operate efficiently for a significant period of time.

Timely diagnostics of the state of the working bodies provides possibility of their timely replacement and ensuring continuous operation of the equipment in a normal mode.

(2) Clogging

Processed organic pulp in most cases (with the exception of applications in the perfumery, food and alcohol industries) contains large particles of various sizes. When substrate processing is carried out by the prototype devices, the largest and longest substrate particles often get stuck between the top of the blades and the adjacent part of the gear (zone 12 on FIG. 1). The sliding of solid particles caught on the edge of the blade along the surface of the rack wheel leads to intensive wear of this rack wheel surface, a sharp increase in energy consumption, overheating of the working area. As the gap between the upper part of the blades and the adjacent part of the gear grows due to the wear, the wear rate increases.

Another mechanism of clogging is the sticking of extended substrate particles on the blades in the zone 15 on FIG. 1. Stuck particles reduce the device's throughput, block the inlet for new substrate portions, and after a while (usually a fraction or a few minutes), the slurry flow to the device's inlet is blocked. Operation of the device in the clogging mode is characterized by an increase in the degree of clogging, a sharp increase in the rate of wear of surfaces, and a significant increase in specific energy consumption.

(3) Air Appearance in the Working Chamber of the Device; Absence or Small Amount of Raw Materials For a number of reasons, the supply of raw materials for processing can be interrupted (clogging of the supply pipe, air pocket, equipment malfunction, etc.). In this case, the device performs multiple processing of the last portion of substrate. The pumping properties of the device in this mode are significantly reduced and the situation would not be changing without an external substrate supply. A substrate portion heats up quickly (it takes 3-20 minutes depending on the type of substrate and processing mode), up to a thermal decomposition. Substrate thermal decomposition products usually can only be removed by a manual cleaning of the device.

(4) Seal Wear Due to Abrasion and Siltation

Seals of different designs are used to ensure the tightness of the shaft inlet into the device, most often a mechanical seal. If abrasive particles are present in the processed pulp, the wear of the seal friction pair is significantly accelerated. The use of a seal made of expensive materials, such as silicon carbide, slows down the wear process, but usually does not solve the problem. In addition, raw material particles accumulate in the sealing cavity, eventually filling the cavity completely. For some schemes and types of seals, such siltation leads to failure of the seal.

(5) Inefficient Operation on Raw Materials of Unstable Composition

In some cases (especially in feed production and substrate processing for anaerobic digestion in biogas plants), the composition of the substrate fed to the inlet of the device is quite unstable. Both the particle content of the liquid and the properties of the particles themselves vary significantly. The use of a single operational mode for the treatment of unstable substrates leads to excessive energy consumption for treatment due to excessive treatment of substrate portions with a low content of solid particles. At the same time, insufficient processing of fibrous raw materials (e.g. straw) is possible.

(6) Exposure to Solid Inclusions.

Stones, metal parts and other solids are not uncommon to be found in substrate in the case of vegetable substrates processing by the device. The design of the device makes it sensitive to such impurities. Lack of diagnostics of presence of solid inclusions leads to the following: the device continues to process a solid object until it breaks down.

The device according to the present invention can solve at least one of the problems described above. In some embodiments, the device according to the present invention can solve all three problems described above. The following implementation example is provided for the purpose of disclosing the characteristics of the invention and should not be considered as in any way limiting the scope of the invention.

In one of the embodiments of the invention, a rotary-pulsation device (FIG. 1) contains stator 1 and rotor 2, located in the housing 3.

The stator 1 is made either separately or in one piece with a cover (not shown in FIG. 1) of the housing 1. On the working surface of the stator 1 there are rows of toothed elements (stator teeth 4) with grooves between them, concentrically arranged around the circumference.

Rotor 2 is made in the form of a disk, the working surfaces of which are made of rows of toothed elements (rotor teeth 5), between which grooves are formed (FIG. 4), concentrically located around the circumference. The rotor 2 is mounted on the drive shaft 6 (not shown on the FIG. 1) with a possibility of rotation together with the shaft, and a shaft 7 is sealed between the shaft 6 and the housing 3.

Figure 4:
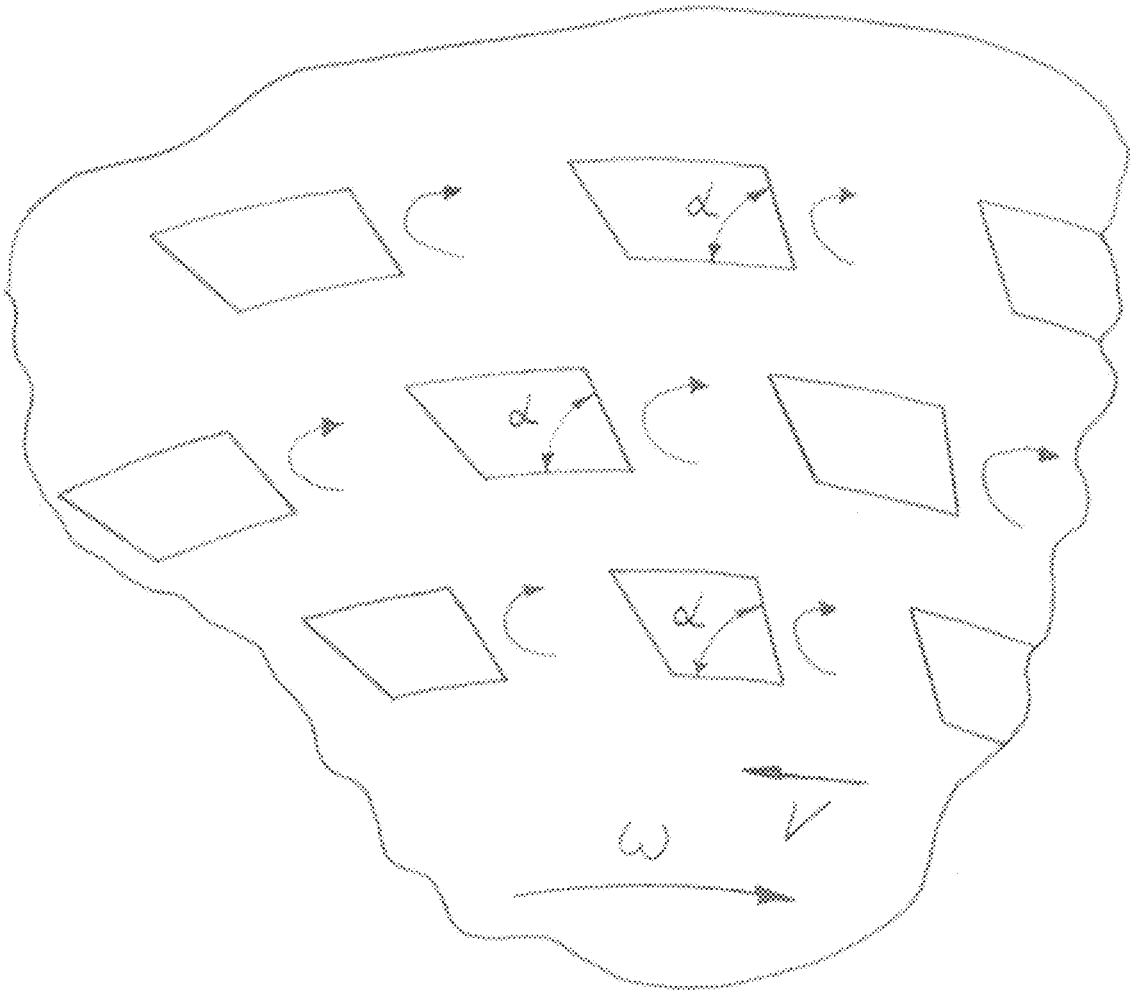
FIG. 4 shows the position of the impeller teeth, and the formation of vortices, where w is an angular speed with which the rotor rotates, v—is an oppositely directed substrate speed; B-B—cross section plane cut.

The annular rows of teeth 4 and 5 are inserted into the corresponding oppositely located grooves of the stator 1 and rotor 2, and the teeth 4 and 5 of adjacent rows are offset relative to each other (FIG. 4). Such an arrangement of the teeth eliminates the through passage of untreated substrate through the open grooves. The leading edge of teeth 4 and 5 is made at an acute angle, in the range of 70-85 degrees, relative to the edge velocity vector, which ensures intensive formation of the vortex motion of the substrate in the closed volume of the groove. With this vortex motion, acceleration of hundreds of G is created, which leads to intensive disruption of cellular structure of organic particles of a substrate.

The substrate is supplied through the inlet 8 located in the Central part of the stator 1. The output of the processed pulp is carried out through the outlet 9 made in the housing 1.

At the edge, on the periphery of the rotor 2, the impeller blades 10 (impeller) are made, which performs the function of an impeller blade, which is aimed at performing three main functions:

- acceleration of the treated pulp, which reduces the clogging probability;
- creating a discharge by pulp flow in the area of the seal and the simultaneous supply of a small volume of liquid into the seal area prevents the abrasive particles from entering the working gap of the shaft seal 7 and significantly increases the seal life;
- removal of bubbles from multiple channels (see below).

In order to increase the efficiency of substrate treatment and elimination of clogging/sticking of particles, an abrasion zone of solid particles 12 is additionally introduced into the device. This zone is formed between the rotor blades 11, made on the working surface of the rotor 2, and additional grooves of the stator 1 (FIG. 2), having an extension from the center of rotation. Under the action of rotation, stuck organic particles falling into this groove are crushed between the upper edge of the blade 11 and additional stator grooves located in zone 12, while the resulting fragments of particles under the action of centrifugal forces enter the processing zone with teeth 4 and 5. Expansion (widening) of the groove profile from the axis of rotation provides an effective evacuation of fragments of particles and preventing clogging of grooves. To perform this function, both the working surfaces of the rotor and the surfaces of the stator slots are hardened to a depth of 0.5 mm.

Also, to increase the efficiency of processing the pulp and eliminate clogging/sticking of particles (particle sticking zone 15) in the stator 1 (if it is made integrally with the housing cover) or in the housing cover (if it is made separately from the stator), a fluid inlet 13 is equipped with valve 14. The liquid used is water or, for biogas applications, the liquid part of the effluent after the separator (centrate) with a solids content of less than 5%. Fluid pressure upstream of the valve is 5-10 bar. The input has a small diameter of 5-15 mm (approximately 0.1-0.3 from the nominal pass of the substrate inlet (item 8 on FIG. 1)).

Figure 3:
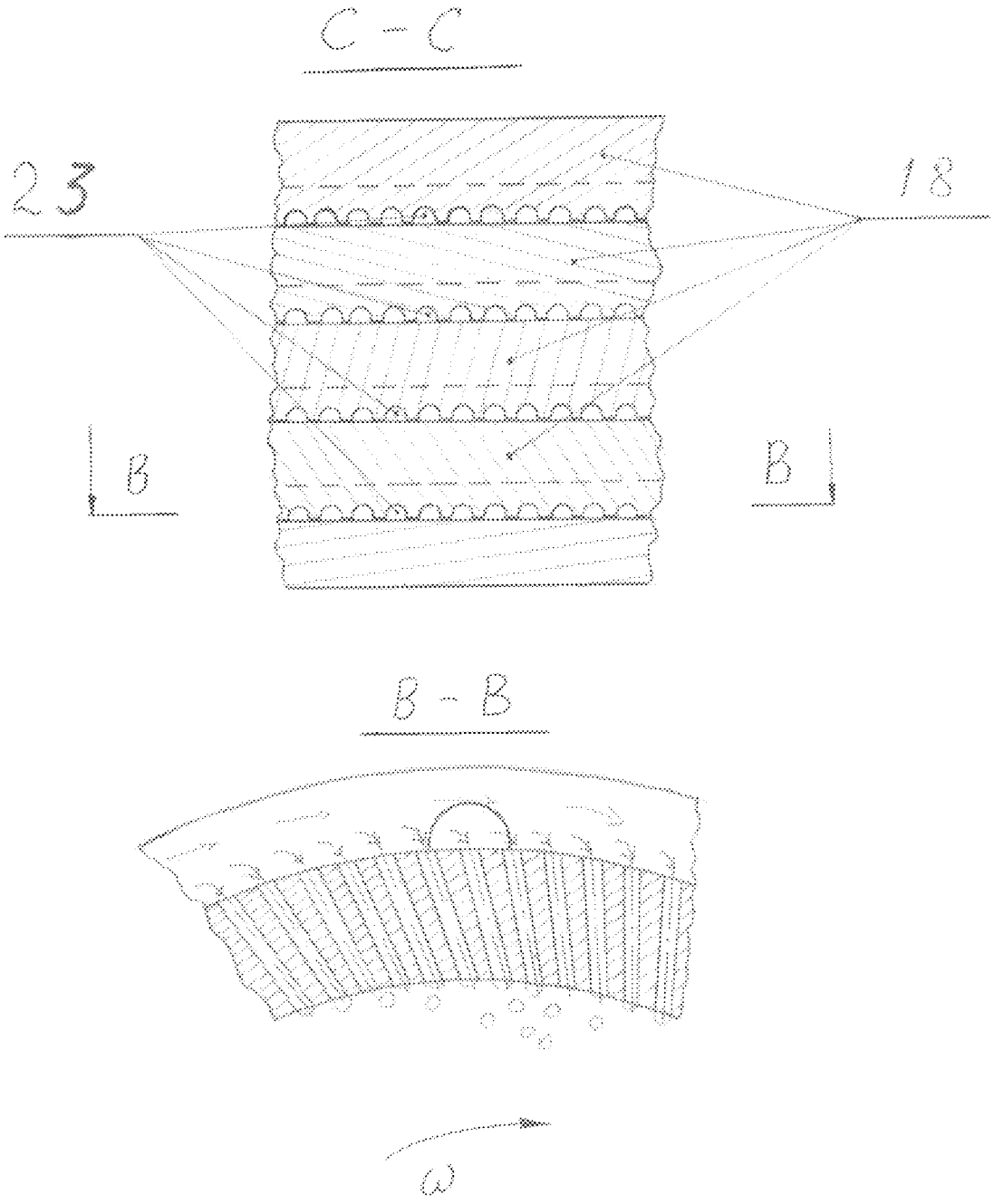
FIG. 3 shows the gas supply unit. 18—gas flow distribution elements; 23—corrugation of gas flow distribution elements.

Another important design solution is the supply of gas to saturate the organic pulp with gas bubbles. Gas supply is carried out through the gas supply fitting 16 mounted on the housing 1. Gas from the fitting 16 is supplied to the gas supply channels 17 located in the flow distribution elements 18 (FIG. 3). On each gas flow distribution element 18 and on the sealing cover 19 on one side, corrugation (knurling) is performed (item 23 on FIG. 3).

To diagnose the state of the working bodies, a vibration sensor (sound receiver) 20 is introduced into the device's design 20. The rotational speed of the shaft 6 can be adjusted according to the readings of the vibration sensor 20. The shaft rotation frequency is adjusted to the maximum efficiency criterion, provided that the motor load is not exceeded. The vibration sensor signals, along with other information, allow the feed rate to be adjusted to ensure optimum loading of the device. This sensor can also be used to diagnose a number of faults, e.g. diagnosis metal or other solid object getting on the inlet of the device.

In this embodiment of the invention, the rotary pulsation device operates as follows. Rotating at high speed (usually 3000 rpm), blades 11 provide rotation of the incoming substrate. Due to the centrifugal force, the substrate is pressed to the stationary teeth 4. As a result of the collision of a moving pulp moving at a speed of 10-50 m/s with stationary teeth, multiple hydraulic shocks occur, while the front edge of the teeth directs the flow of pulp along a vortex path (edge—movable tooth 5—edge of the stationary tooth 4). The counter-directional flows collide with moving teeth 5 with the energy increased during the oncoming movement, the result of the collision is the appearance of hydraulic shocks and the movement of the pulp flows along the vortex paths (the edge of the moving tooth 5—the stationary tooth 4—the edge of the moving tooth 5).

The maximum impact on the processed substrate occurs if the period of vortex flow excitation coincides with the time of the vortex flow movement inside a closed niche. This movement time depends on the viscosity of the pulp and also changes with a change in the temperature of the pulp, the content of solid particles and bubbles in the substrate, and when the size of the teeth changes due to abrasive wear. The most effective operation of the device is provided by continuous correction of the shaft speed 6 according to the criterion of the maximum signal level recorded by the sound receiver 20.

When processed substrates contain large and extended fragments of organic materials, some of these fragments may adhere to the front edge of the blades in Zone 15. Valve 14 is opened periodically for a short period of time (a few seconds) or by the signal of the sound receiver 20 and the fluid flow through the fitting 13 is directed to the adhesion zone of the raw material particles. The oncoming movement of the fluid flow and adhering particles provides an effective flushing of particles for further processing in normal mode.

Figure 2:
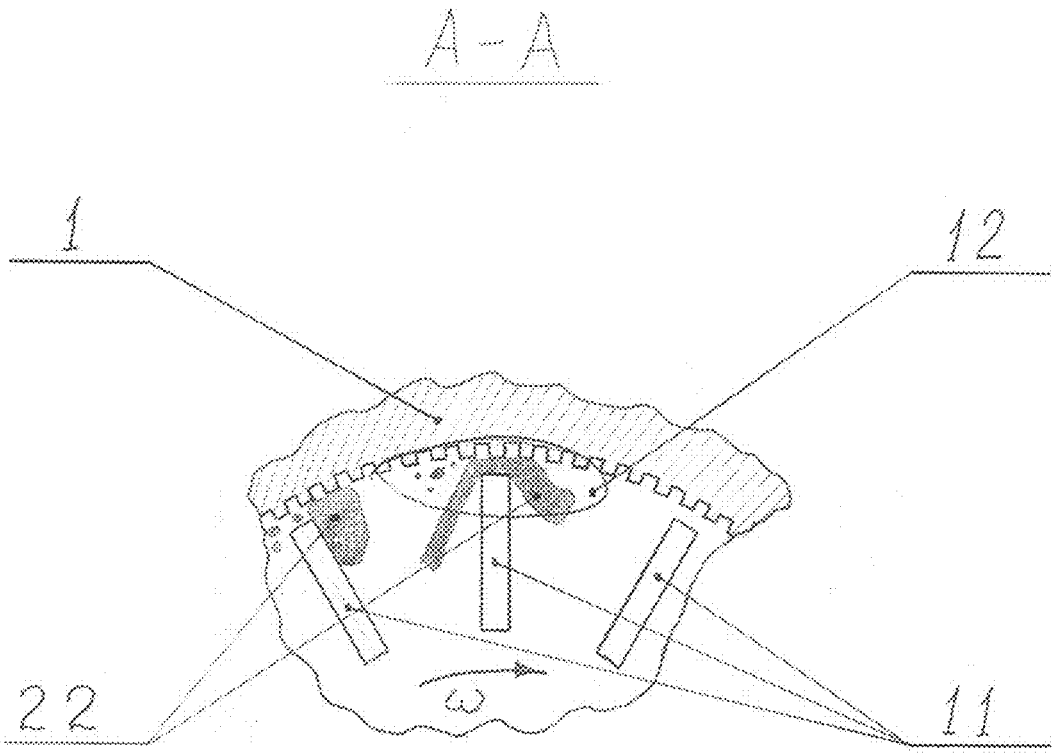
FIG. 2 shows configuration of the particle abrasion zone. The following positions are indicated on the FIG.: 1—stator (with rack wheel), 11—inner impeller blades, 12—substrate particles abrasion zone; 22—solid substrate particles that reached the abrasion zone.

Fragments of coarse and extended particles of organic materials can fall into the gap between the upper surface of the blades and the adjacent part of the gear (zone 12 FIG. 1). To exclude intense wear of the surface of the rack wheel due to the sliding of the stuck particles, grooves are made on the conical surface of the gear having a widening in the direction from the axis of rotation (FIG. 2). The periodic impacts of organic fragments by the edges of the grooves as they move along the rack wheel surface change the size and geometry of the fragments almost instantly, which ensures that these fragments enter the processing area between the teeth 4 and 5.

The pulp subjected to repeated hydraulic shocks carried out by the teeth 4 and 5 enters the gap between the rotor 2 and the elements forming the outer wall (housing 3, gas flow distribution elements 18, sealing cover 19), made in the form of a cone increasing the diameter towards the outlet holes 9. The blades 10 provide the pulp with a rotational motion, and the increase in the diameter of the cone ensures a steady evacuation of the treated pulp from the device. The movement of the pulp creates a small discharge in the area of the seal 7, which is sufficient to prevent the pulp from entering the seal. Reduced pulp access, including abrasive components, extends seal service life.

Fitting 16 is used to supply gas to channels 17. The gas composition depends on the problem being solved. The knurling made on the surface of the gas flow distribution elements 18 and the sealing cover 19 ensures the distribution of gas flow into thousands of channels having an effective cross section of less than 0.1 $mm^2$. Through these channels, the gas enters the gap between rotor 2 and the elements forming the outer wall. At a short distance (approx. 1 mm) from the outlet of the channels, the blades 10 are rotating, providing intensive substrate movement. The pulp affects the gas bubbles released from the channels due to the high speed (20-50 m/s), which ensures that the bubbles with a diameter of 0.1 mm or less are detached. The progressive substrate motion and high turbulence of the flow ensure an even distribution of the gas bubbles in the flow.

The liquid can be injected into the area around the seal 7, through the fluid supply channel 21 and the channel made in the housing 1. Composition of the liquid injected corresponds to the substrate processed. Small amounts of liquid (approximately 0.1-1% of the device's capacity in terms of the volume of the processed pulp) are carried away in the discharge zone and evacuated through outlet 9, entraining abrasive particles contained in the treated pulp. Thus, the seal 7 is protected from the impact of abrasive particles, siltation of the seal area is eliminated, and the seal service life is increased.

All kinds of oscillations occurring in the device are registered by the broadband sound receiver 20. The spectrum of oscillations in real time is used to diagnose the modes of operation of the device.

Below is description of a causal relationship between the technical result achieved by the device and the essential features of the device.

Impeller

When substrate processing is carried out by the prototype devices, the pressure of the treated pulp created by the feed blades is completely exhausted when the pulp passes the teeth. The treated pulp stagnates in the outer zone of the device volute, which in some cases leads to clogging, especially when processing fibrous materials. The lack of pressure properties of the prototype forces it to be used in conjunction with a pump.

Figure 5:
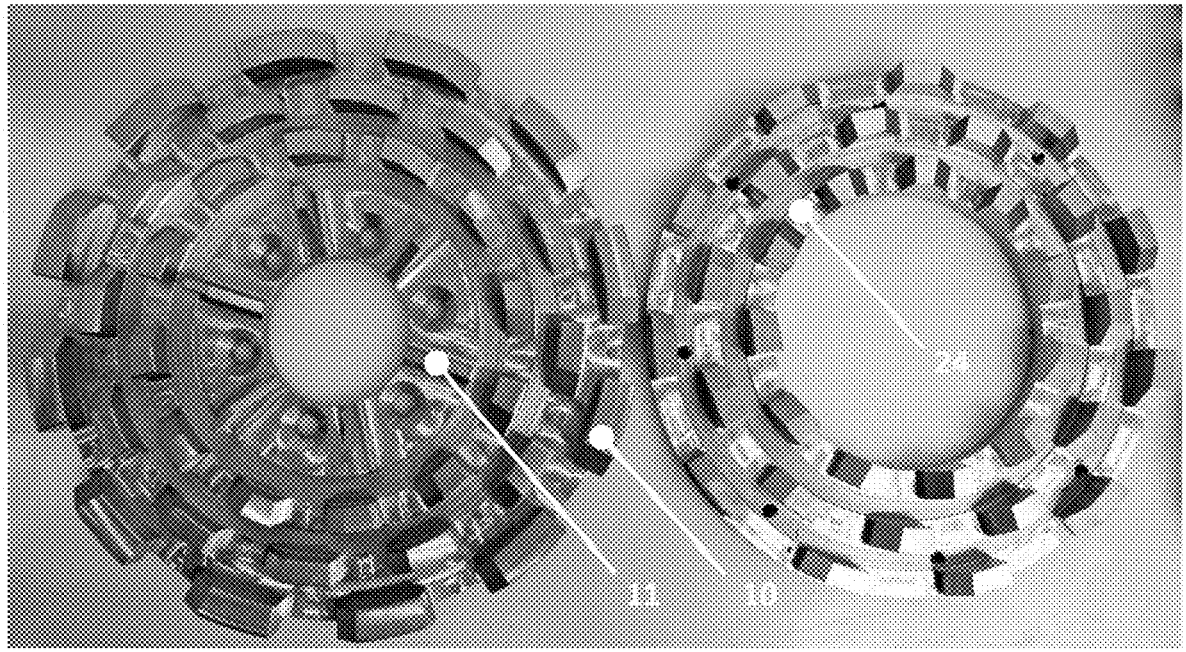
FIG. 5 shows an example of the working bodies (impeller and rack wheel) design, where: 11—inner impeller blades; 10—outer impeller blades; 24—rack wheel.
Figure 6:
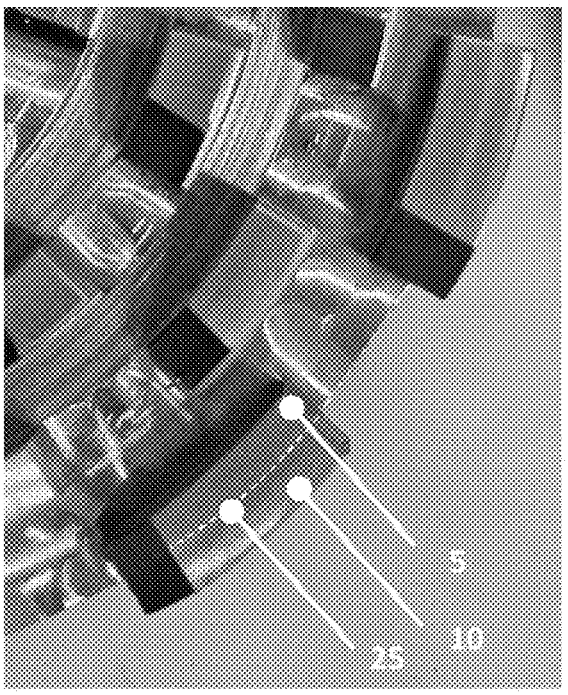
FIG. 6 shows the design of the rotor teeth and outer impeller blades from the example on the FIG. 5, where: 5—rotor teeth, 10—outer impeller blades; 25—schematic boundary between the rotor tooth and the impeller blade; the rotor tooth and the outer impeller blade form a single element.

According to the invention, the outer impeller blades are introduced in the device (item 10 on FIG. 1, FIG. 5 and FIG. 6). The part of the tooth protruding beyond the outer diameter of the rotor serves as a blade, and upon that the rotor tooth and the outer impeller blade form a single element.

Outer impeller blades perform three functions:

- impeller accelerates the treated pulp, excluding stagnation;
- the pulp stream creates a discharge in the area of the seal and abrasive particles do not get into the working gap of the mechanical seal (item. 7 on FIG. 1);
- the impeller blades remove the bubbles from the multiple channels of the elements 18;

The effective functioning of the blades and the performance of the three functions is ensured by the following features:

- the inner surface of the elements of the distribution of the gas flow is made in the form of a cone with an extension towards the outlet;
- the outlet is offset relative to the plane of rotation of the teeth 4 and 5.

Elimination of Clogging/Sticking of Particles and, as a Result, Increased Processing Efficiency The tendency of the device to clogging is eliminated by two additions in the design of the device:

According to the invention, a fluid inlet 13, equipped with a valve 14, is placed on the stator. The liquid is water or, for biogas applications, the liquid part of the effluent after the separator (centrate) with a content of solids less than 5%. It is not necessary to use water as a liquid, e.g. chloroform can be used for the extraction of components of plant materials. The input has a small diameter of 5-15 mm (approximately 0.1-0.3 from the nominal pass of the substrate inlet).

For a short time (1-2 sec), the valve is opened and the fluid through the inlet is directed to the particle sticking zone. The fluid flow rate is 2-5 m/s. Counter linear velocity of adhering particles is 15-30 m/s. A short fluid impulse effectively washes away stuck particles, as the adhesion force of the particles and rotor blades is low. Processing is repeated periodically, the frequency depends on the type of raw material, in the most difficult cases the frequency is 3 min. When the valve is triggered by a sensor signal 14, water and energy can be used to trigger the valve only when the process of clogging begins.

Gas Saturation

In some applications of the device, saturation of the organic pulp with gas bubbles is required. For example, in the production of biogas it is useful to saturate the pulp with carbon dioxide bubbles, in the confectionery industry—with air, for example, in the industrial preparation of bizet, pastilles, marshmallows, sweets.

When used in the biogas industry, it is convenient to use biogas consisting of a mixture of methane, carbon dioxide and other gases rather than pure carbon dioxide. Instead of carbon dioxide, it is also possible to use purified exhaust gases from a working cogeneration plant—they consist mainly of nitrogen and carbon dioxide.

In the food industry, purified air is most often used, but it is also possible to use nitrogen, carbon dioxide and other gases.

In order to eliminate excessive elements, as well as to increase the efficiency of gas injection and to obtain small bubbles, the most convenient way of gas injection is to introduce it directly into the device. In this case, the device performs the functions of pulp treatment, pumping and gas saturation, which is more cost-effective than using three different devices to perform these functions.

An important parameter when introducing gas is the size of the resulting bubbles. For basic applications, it is important to obtain bubbles as small as possible, less than 0.5 mm. According to the invention, the gas is introduced through one or several rows of small (Ø 0.3-0.5 mm) diametrically arranged openings made on the elements (pos. 18), which are mounted near the rotor (FIG. 1, FIG. 3). At a distance of 0.5-1 mm from the holes at a high speed (20-40 m/s), the impeller blade 10 rotates. An intense flow of fluid blows out the emerging small bubbles (0.2-0.5 mm), preventing them from reaching the size 2-5 mm, which are obtained without intensive exposure to the liquid.

In order to eliminate the expensive drilling of multiple holes according to the invention, the holes were obtained by pressing the parts with fine corrugations of 0.5 mm on their surface. The pressing of such elements 18 provides more than a thousand holes with a nominal diameter of less than 0.37 mm of each hole with a diameter of 200 mm. Making of knurled holes solves the problem of small diameter holes drilling, and also provides a possibility of practical application of the described device, as the cost of drilling many holes with diameter of 0.5 mm excludes practical use for economic reasons.

Seal Protection

When processing pulp with a high content of abrasive components there is a problem of the reduced life of the seal 7. Abrasive particles get caught between rubbing surfaces and rapidly damage the seal. Seal replacement is a time consuming procedure and expenses for a new seal are required. The liquid composition corresponds to the pulp being processed. To achieve the useful effect the small amount of liquid is enough (approximately 0.1-1% of the device's capacity in terms of the volume of the processed pulp). The fluid is supplied through the fluid supply channel 21, carried away in the discharge zone and evacuated through the outlet 9, entraining abrasive particles contained in the treated pulp. Thus, the seal 7 is protected from the impact of abrasive particles, siltation of the seal area is eliminated, and the seal service life is increased.

According to the invention, a channel and a fitting 21 are provided in the housing 1, through which the liquid is introduced into the seal zone 7.

Vibration Sensor (Sound Receiver)

When arranging raw material processing lines, it is important to have information on the status of the flow-through substrate processing device included in such a line.

Diagnostics of the condition of the working bodies provides a possibility of timely replacement and constant operation of the equipment in normal mode. The abrasive wear of the operating elements is accompanied by a change in the character of the sound generated by the processing. The main tone intensity decreases proportionally to the degree of wear, the intensity of the high-frequency component significantly decreases, and low-frequency tones usually do not occur.

Stuck particles in the area (item 15 on FIG. 1), significantly change the noise that accompanies processing. At the same time, the intensity of the main frequency of fluctuations decreases due to blocking of a part of teeth, characteristic low-frequency oscillations occur in the range of 50 Hz due to the occurrence of rotor imbalance. The magnitude of the changes is proportional to the degree of clogging.

A quick determination of the moment of clogging start (within 1-3 sec) allows to efficiently clean up clogging automatically, and the cleaning mode is switched on only if necessary. Such an operating algorithm ensures minimal resource consumption for cleaning (each switch-on of the cleaning system is an energy consumption), saves liquid (which dilutes the substrate processed), and increases the efficiency of the cleaning system (single particles are easier to remove than the resulting particles agglomeration). The automatic cleaning system eliminates the need for manual removal of clogging.

There may be a situation where there is air in the chamber and there is little or no substrate in the chamber—which is accompanied by a sharp drop in pumping properties and the process of substrate feeding requires correction. Such situations can be eliminated by analyzing the noise spectrum using a vibration sensor (sound receiver). In this situation, the noise intensity drops sharply at all frequencies. The signal about the lack of raw materials can be used to stop the operation of the device to eliminate negative consequences and eliminate an excessive energy consumption.

In case of processing substrates with a large amounts of stones and abrasive particles, repeated impacts on solid impurities, which should not be present in the substrate, are diagnosed. This situation is identified by a signal from a sound receiver having multiple intense bursts with a wide spectrum.

To obtain information about these processing regimes, a broadband sound receiver 20 is installed on the front cover of the housing or on the outside of the stator of the device, for example, an automobile vibration sensor type G305 or a hydrophone may be used. Fluctuations of the liquid and the working bodies, cause elastic vibrations of the material of the stator 1, reach the sensor 20 located in the immediate vicinity of the oscillation source. The sensor converts vibrations into alternating voltage, the spectrum of which contains information about the device operating mode. The signal from the sensor (primary transducer) is transferred to a specialized spectrum analyzer implemented on the microprocessor. The signal processing unit determines the operating mode of the rotor-pulsation device based on the signal spectrum. To increase the reliability of the device, several broadband sound receivers can be used simultaneously.

The use of the vibration sensor signal together with the information on the load on the electric motor allows to significantly reduce the specific energy consumption for the processing of substrates with unstable composition. For this purpose, the feed rate of the substrate to be processed is adjusted according to the load on the electric motor that drives the device, and according to the information about the substrate processing mode, received from the vibration sensor. In many cases, the composition of the substrate fed for treatment is an unstable in time. This is usually the case with substrate for the biogas plants, feed preparation and other applications. In the case of feedstock with small amounts of inclusions, a very high processing speed can be maintained. In some cases, the rotor speed can even be reduced. As soon as an increase in engine load in the substrate or the beginning of a blockage (small amount of long fibers causing clogging) is recorded, the substrate feed rate is reduced. Detection of the presence of solid inclusions (stones, metal parts, etc.) in the substrate in most cases allows timely switching off the device, avoiding the destruction of the working bodies.

Despite the fact that the invention has been described with reference to the disclosed variants of the invention embodiments, it should be obvious to the those skilled in the art that the specific, detailed described experiments are shown for the purpose of illustrating this invention only, and should not be considered as those that in any way confine the scope of the invention. It should be understood that various modifications or equivalent features may be introduced in other embodiments without deviation from the essence of this invention.

The invention claimed is:

1. A rotary pulsation device, comprising a drive, a stator, and a rotor mounted on a shaft and made in the form of a disk with a working surface, wherein:

a body of the device is equipped with an outlet and a gas supply fitting connected by gas supply channels with gas flow distribution elements clamped by a sealing cover;

the stator is made with working and conical surfaces, and is equipped with an inlet located in its central part, and a fluid inlet fitting, equipped with a valve;

working surfaces of the stator and rotor have concentric rows of teeth arranged along an axis of rotation, the teeth of adjacent rows of the rotor and stator are offset with respect to each other, and between the adjacent rows of the above-mentioned teeth grooves are provided;

on an outer diameter of the working surface of the rotor, external impeller blades are provided, the external impeller blades protruding beyond an outer diameter of the rotor, and between the axis of rotation of the rotor and the rows of teeth on the working surface of the rotor, internal blades of the impeller are provided;

additional grooves are provided on the conical surface of the stator and expand from a center of rotation;

a particle crushing zone is provided in the device between inner rotor blades and additional stator slots;

a vibration sensor is mounted on an outer side of the stator and a signal processing unit implemented on a microprocessor is configured to determine an operating mode of the rotary pulsation device based on a spectrum of a signal received from the vibration sensor.

2. The device according to claim 1, wherein an outer wall of a housing in which the rotor is installed is made in the form of a cone, and the radius of the cone increases towards the outlet of the device.

3. The device according to claim 1, wherein a corrugation in the form of knurling is made on each of the gas flow distribution elements and on the sealing cover.

4. The device according to claim 1, wherein a front edge of the rotor and stator teeth is made at an acute angle, in the range of 70-85 degrees, relative to an edge velocity vector.

5. The device according to claim 1, wherein three rows of teeth are provided on the working surfaces of the stator and rotor.

6. The device according to claim 1, wherein the gas supply channels are diametrically located and provided in one or more rows, a diameter of the channels is 0.3-0.5 mm, and the channels are located at a distance of 0.5-1 mm from the external impeller blades.

7. The device according to claim 1, wherein the vibration sensor is made in the form of an automobile vibration sensor of the G305 type or a hydrophone.

* * * * *